US005377508A

United States Patent [19]

Hair et al.

[11] Patent Number: 5,377,508

[45] Date of Patent: Jan. 3, 1995

[54] APPARATUS AND METHOD FOR PROVIDING DUAL WASHING CAPACITY

[75] Inventors: James A. Hair; Evan R. Vande Haar, both of Newton, Iowa

[73] Assignee: Maytag Corporation, Newton, Iowa

[21] Appl. No.: 194,038

[22] Filed: Feb. 9, 1994

[51] Int. Cl.[6] ..... D06F 35/00

[52] U.S. Cl. ..... 68/4; 29/401.1

[58] Field of Search ..... 68/4; 29/401.1

[56] References Cited

U.S. PATENT DOCUMENTS

| | | | |
|---|---|---|---|
| 1,590,470 | 6/1926 | Means | 68/4 X |
| 2,591,290 | 4/1952 | Rasmussen | 68/4 X |
| 2,836,301 | 5/1958 | Bruckman . | |
| 2,966,051 | 12/1960 | Gerhardt . | |
| 3,278,037 | 10/1966 | Stelli et al. . | |
| 3,390,554 | 7/1968 | Morgan . | |
| 3,509,740 | 5/1970 | Bochan | 68/4 X |
| 3,603,118 | 9/1971 | Brucken et al. . | |
| 4,502,303 | 3/1985 | Wasemann . | |

FOREIGN PATENT DOCUMENTS

| | | | |
|---|---|---|---|
| 136436 | 2/1950 | Australia | 68/4 |

*Primary Examiner*—Philip R. Coe

*Attorney, Agent, or Firm*—Zarley, McKee, Thomte, Voorhees & Sease

[57] ABSTRACT

A dual capacity washing machine includes an outer tub having an open end. A first wash basket having a first capacity is mounted within the outer tub, and can be interchanged with a second wash basket having a second capacity. A first tub cover is detachably mounted over the open end of the outer tub and includes a transition surface into and out of the first wash basket. A second tub cover can be interchanged with the first tub cover and includes a transition surface extending toward the second wash basket. The combination of the first wash basket and the first tub cover provide a first wash capacity and the combination of the second wash basket and second tub cover provide a second washing capacity.

11 Claims, 5 Drawing Sheets

APPARATUS AND METHOD FOR PROVIDING DUAL WASHING CAPACITY

BACKGROUND OF THE INVENTION

This invention relates to an apparatus and method for providing dual washing capacity.

Automatic fabric washing machines generally include an outer tub having an inner tub or washing basket mounted therein. An agitator is centrally mounted within the washing basket. The agitator is rotated in a reciprocating fashion, and the washing basket is rotatable at certain tinges during the washing cycle in order to spin dry the fabrics after they have been washed. A transmission is mounted below the outer tub and is connected to the washing basket and the agitator for selectively driving them. The washing tub assembly is mounted within a cabinet and is supported by support braces.

Some manufacturers have in the past offered customers two choices of tub capacity in an automatic washer. To offer this choice it has been necessary to manufacture two different sizes of outer tubs, two different lengths of transmissions, and two different lengths of tub support braces which function with two different capacity inner tubs or wash baskets.

Therefore a primary object of the present invention is the provision of an improved apparatus and method for providing dual washing capacity in an automatic washing machine.

A further object of the present invention is the provision of an apparatus and method for providing dual washing capacity while using the same size of outer tub without requiring different transmission lengths or tub support braces.

A further object of the present invention is the provision of an apparatus and method for providing dual washing capacity which utilizes two different tub covers which are interchangeably mountable to the upper edge or rim of the outer tub, and which accommodate two different sizes of wash baskets having different capacities.

A further object of the present invention is the provision of an improved apparatus and method for providing dual washing capacity which permits easy assembly and disassembly in order to change the capacity of the washing machine.

A further object of the the present invention is the provision of an apparatus and method for providing dual washing capacity which is economical to manufacture, durable in use, and efficient in operation.

SUMMARY OF THE INVENTION

In a preferred embodiment of the invention, the forgoing objects are achieved by a dual capacity washing machine having all outer tub with an open end. A first inner tub or wash basket is mounted within the outer tub and has a first predetermined capacity for receiving the items to be washed. A first tub cover is mounted on the outer tub adjacent the periphery of the open end and includes a transition surface extending inwardly toward the first inner tub to provide a transition into and out of the first inner tub.

A second inner tub or wash basket is selectively interchangeable with the first inner tub or wash basket and is mounted within the outer tub. The second inner tub includes a second capacity different from the capacity of the first inner tub.

For use with the second inner tub is a second tub cover which is interchangeable with the first tub cover. The second tub cover is mounted on the outer tub adjacent the periphery of its open end, and includes a transition surface extending inwardly toward the second inner tub to provide a transition into and out of the second tub. As a result of this configuration the combination of the first inner tub and the first tub cover provide a first wash capacity and the combination of the second inner tub and the second tub cover provide a second wash capacity.

DETAILED DESCRIPTION OF THE PREFERRED EMBODIMENT

Figure 1:
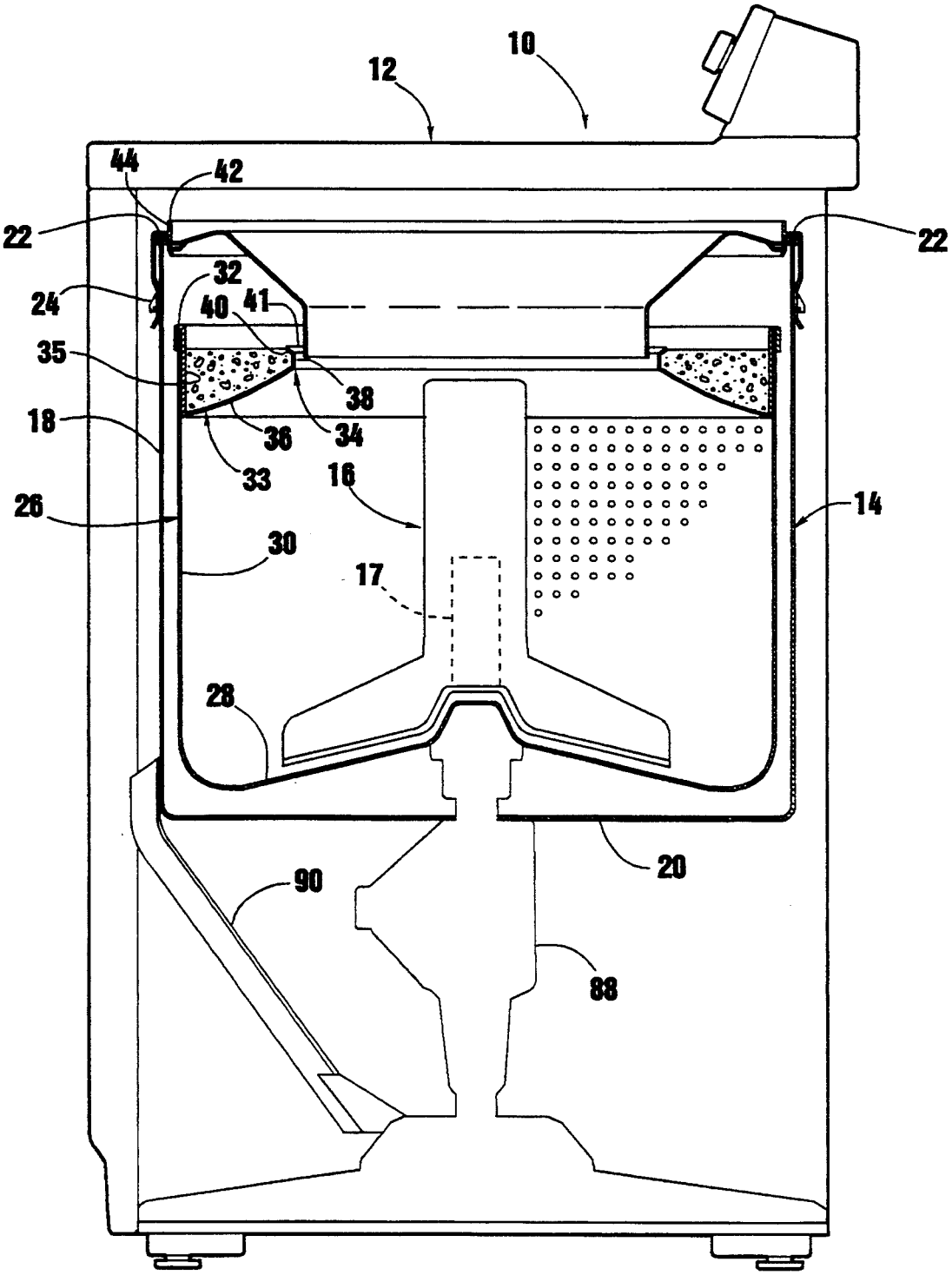
FIG. 1 is a sectional view of a washing machine utilizing a first tub cover and a first inner wash basket for providing a first washing capacity.

Referring to the drawings the numeral 10 generally designates a washing machine. While washing machine 10 is shown to be a vertical axis washing machine, the present invention may also be adapted to accommodate a horizontal axis washing machine.

Washing machine 10 includes a cabinet 12 in which is mounted an outer tub 14 supported by several support braces 90. Outer tub 14 includes tub sidewall 18, a tub bottom wall 20 and a tub upper rim 22. On the outside surface of tub 14 adjacent its upper end are a plurality of latch hooks 24.

Figure 1A:
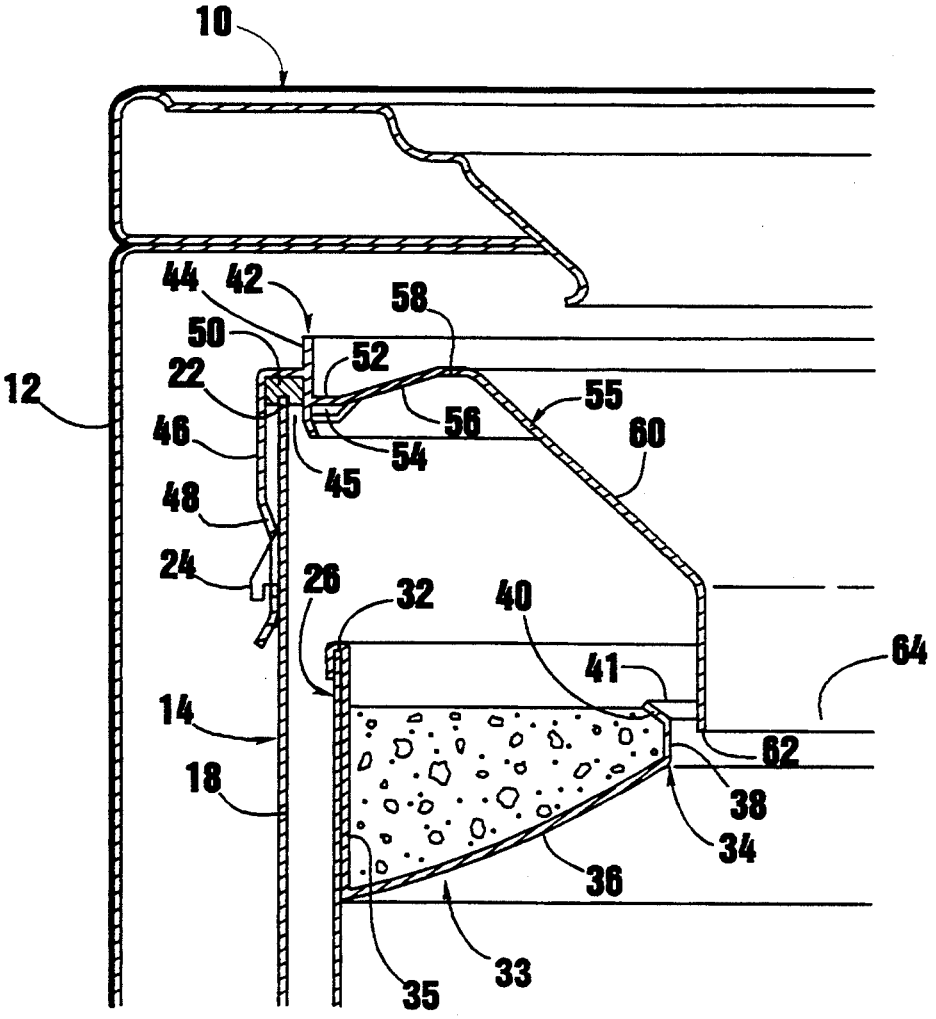
FIG. 1A is an enlarged detailed sectional view of the upper left hand corner of FIG. 1.

A first wash basket 26 is mounted within tub 14 and includes a bottom wall 28, sidewall 30 and an upper edge 32. A balance ring or weight ring 33 is mounted over the upper edge 32 of the wash basket 26. The balance ring 33 is formed as an annular structure of suitable plastic material. In cross-section, as best shown in FIG. 1A, the balance ring 33 has a U-shape including a generally vertical wall section 35 closely adjacent the sidewall 30 of wash basket 26. Spaced a short distance below the upper edge 32 of the wash basket 26 and forming part of the U-shape is an annular rim 34 which commences at wall section 35 and includes an arcuate wall portion 36, a vertical wall portion 38, and a tapered flange 40 which forms an upwardly presented basket opening 41. The U-shape of the balance ring 33 is filled with a suitable weight material such as a concrete or Portland cement mixture the density of which may be increased by the use of either a heavy aggregate or metal shot particles to give the balance ring 33 the necessary mass. Since the balance ring 33 has a high density and is located at the highest point on wash basket 26, when the wash basket 26 is rotated, the balance ring 33 provides a gyroscopic stabilizing effect to minimize movement of the tub assemblies with respect to the cabinet 12 of the washing machine 10.

A transmission 88 is mounted below outer tub 14 and extends through the bottom wall 20 thereof. Extending upwardly from transmission 88 is a splined spindle 17 on which is detachably mounted a first agitator 16. Agitator 16 is driven by spindle 17 so as to rotate in a reciprocating fashion to provide washing agitation of the fabrics being washed. The wash tub or basket 26 is adapted to be rotated by the transmission 88 during the spin cycle of the washing operation. The first inner tub or wash basket 26 includes perforations in its bottom and side walls 28 and 30 so that washing fluid can flow freely back and forth between the outer tub 14 and the interior of the wash basket 26.

Figure 3:
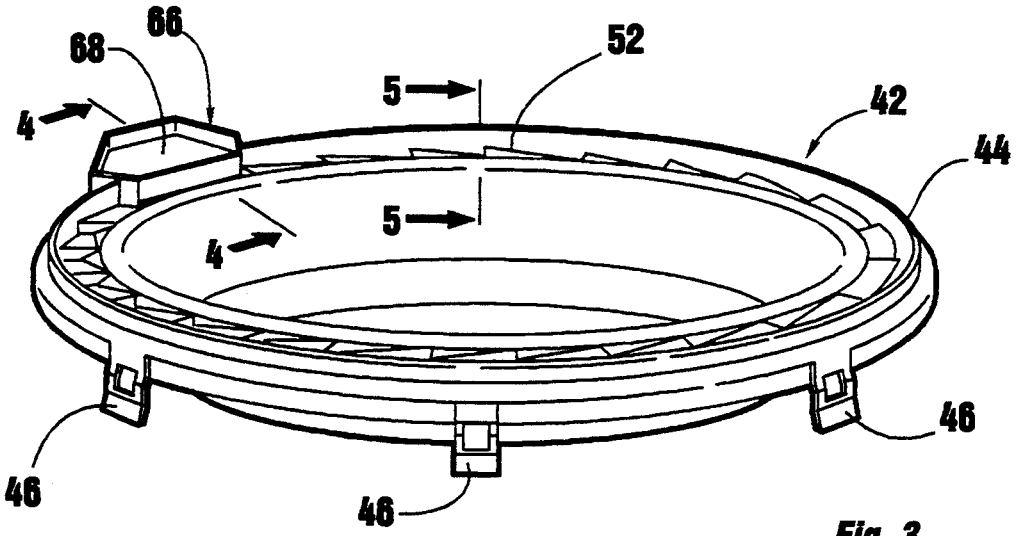
FIG. 3 is a perspective view of the tub cover shown in FIG. 1.
Figure 4:
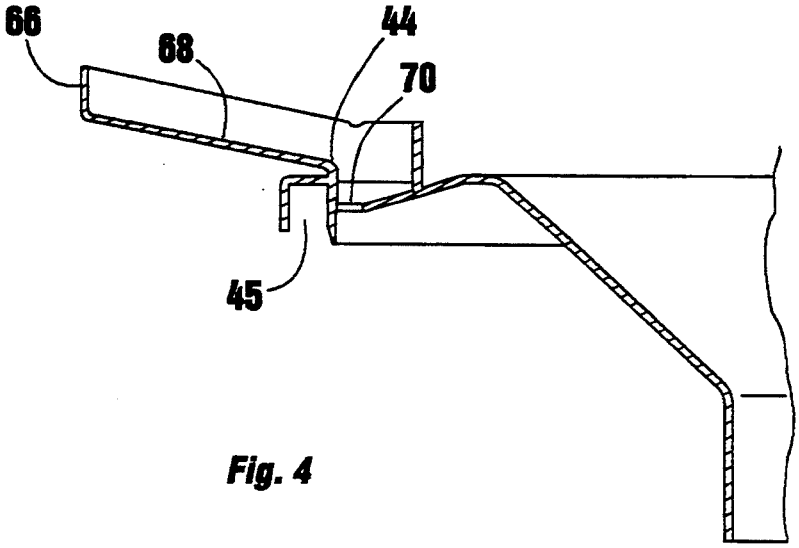
FIG. 4 is a sectional view taken along line 4—4 of FIG. 3.
Figure 5:
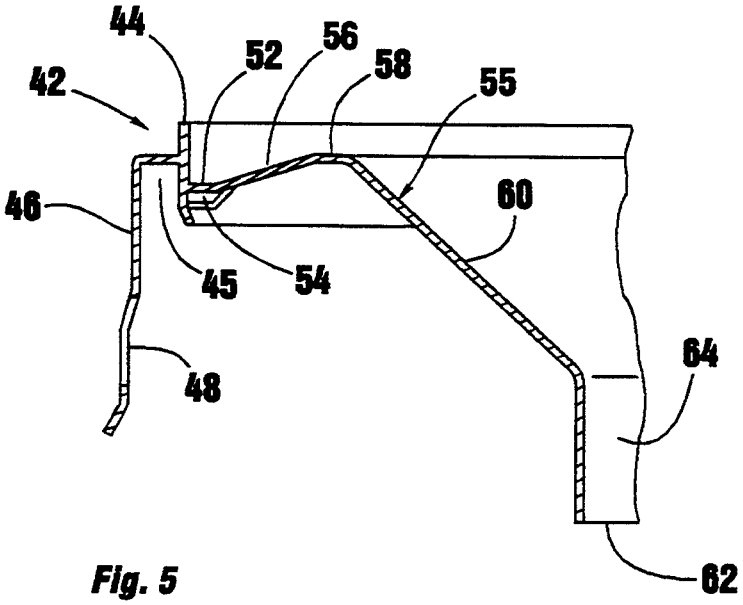
FIG. 5 is a sectional view taken along line 5—5 of FIG. 3.

Mounted over the top edge 22 of outer tub 14 is a first tub cover 42. As best shown in FIGS. 3–5, tub cover 42 includes a circular collar 44 having a downwardly facing U-shaped channel 45 formed on the outer surface thereof. The purpose of U-shaped channel 45 is to fit over the upper edge 22 of outer tub 14 as shown in detail in FIG. 1A. A plurality of clip members 46 depend downwardly from the U-shaped channel 45 and include clip openings 48 which retentively fit over the latch hooks 24 on the outside surface of outer tub 14. A gasket 50 is fitted within the U-shaped channel 45 to provide a cushion and water tight seal between the channel 45 and the upper edge 22 of the outer tub 14.

Extending around the inner surface of circular collar 44, as best shown in FIGS. 3 and 5, are a plurality of ramped channels 52 having drain holes 54 formed at each ramped end thereof. A first tub cover rim 55 commences at circular collar 44 and extends upwardly along an inclined drain surface 56 to a horizontal surface 58 and then downwardly along a tapered surface 60 to a lower tub cover rim 62 which forms a lower tub cover opening 64. The drain surface 56 causes water or other fluid to be drained outwardly toward circular collar 44 so that it can fall through the drain holes 54 into the outer tub 14. The primary purpose of the tub cover rim 55 is to provide a transition surface between the larger diameter rim 22 of the outer tub 14 and the smaller diameter basket opening 41 located below the rim 22. As can be seen in FIGS. 1 and 1A, the lower tub cover opening 64 of tub cover rim 55 is registered with the basket opening 41 of inner wash basket 26.

As can best be seen in FIGS. 3 and 4, an inlet spout 66 is connected to the annular collar 44 of first tub cover 42 and is adapted to receive bleach or detergent from a dispenser (not shown) for injecting bleach or detergent into the tub and basket assembly. Inlet spout 66 includes an inclined wall 68 which at its lower end includes a plurality of inlet holes 70 for permitting the bleach or detergent to enter the outer tub 14.

Figure 2:
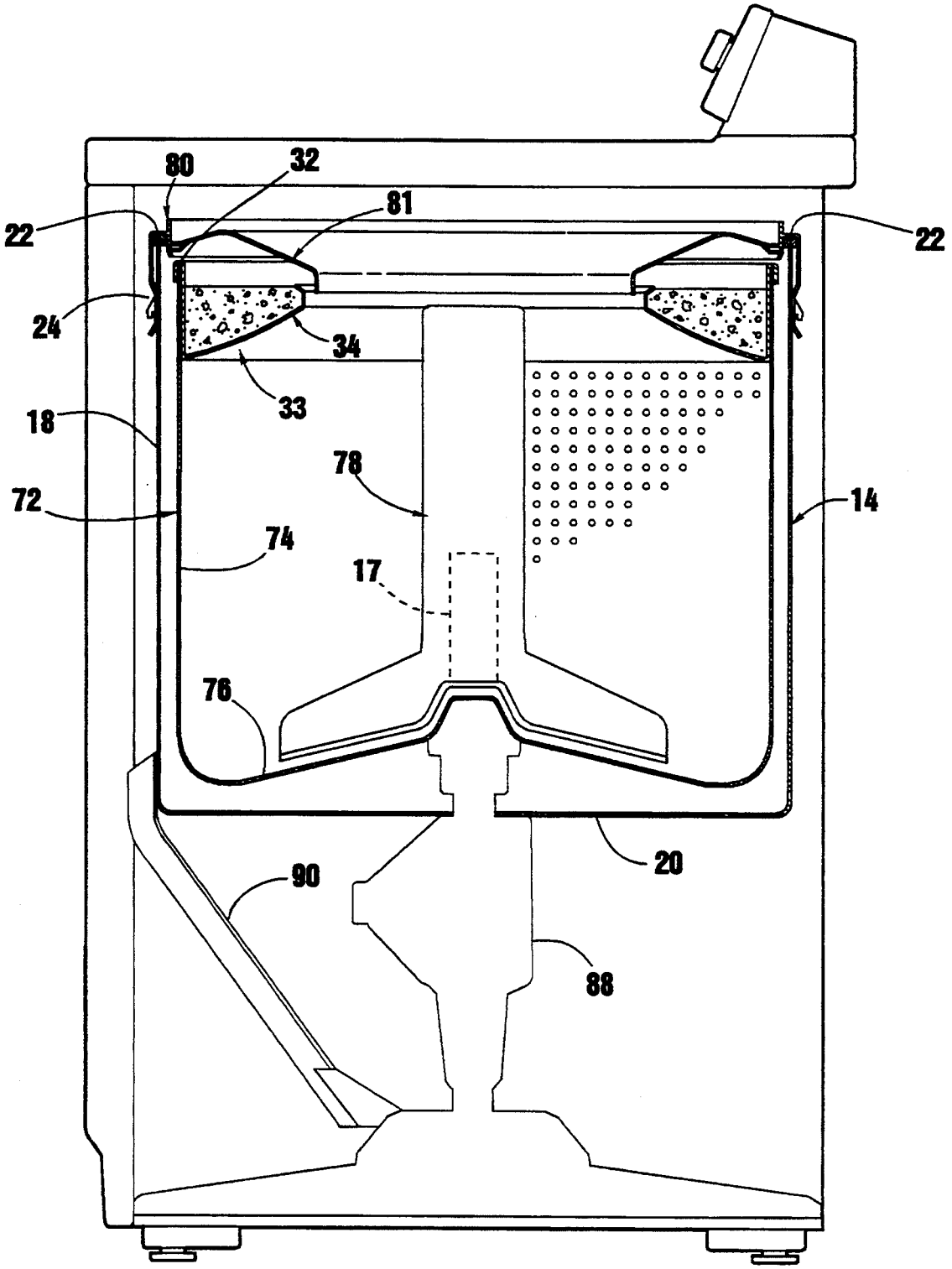
FIG. 2 is a view similar to FIG. 1 showing a second tub cover and a second inner wash basket having a second wash capacity.
Figure 2A:
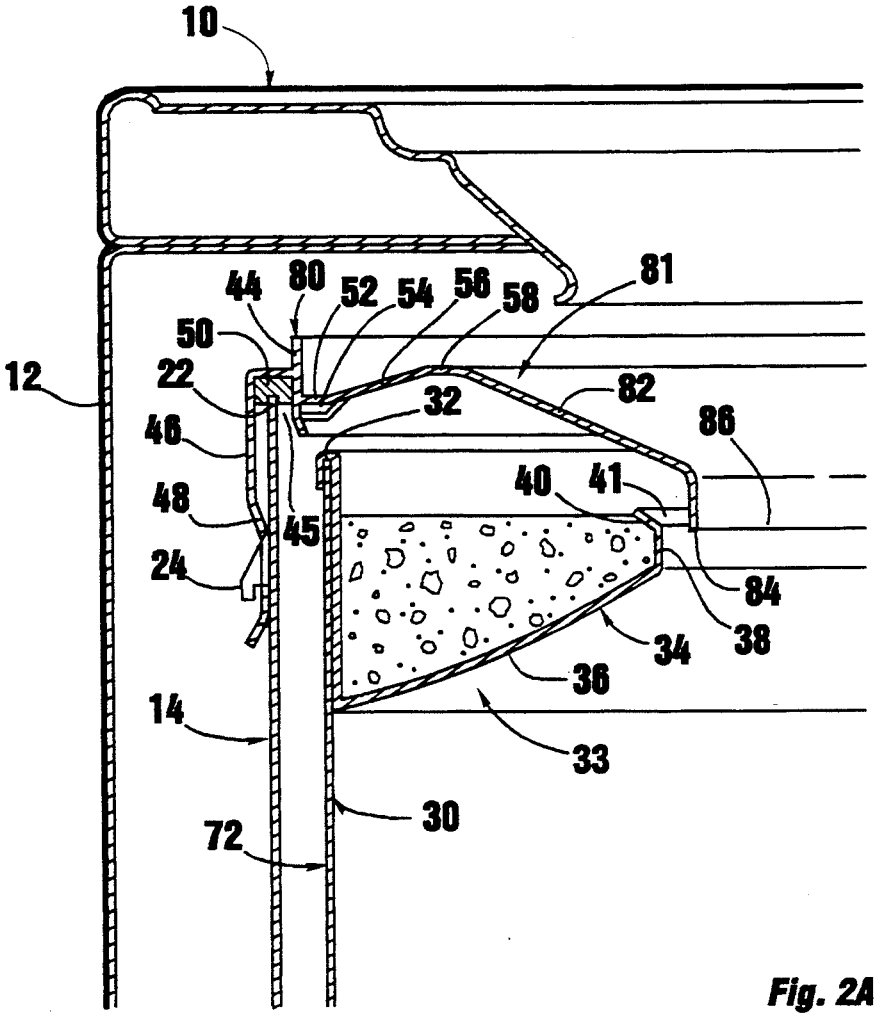
FIG. 2A is a detailed sectional view of the upper left hand corner of FIG. 2.

Referring to FIGS. 2 and 2A, the washing machine 10 can be provided with a second inner tub or wash basket 72 having a second agitator 78 therein and provided with a second tub cover 80. Parts which correspond between the configuration shown in FIG. 2 and the configuration shown in FIG. 1 retain the same numerals. One difference between the wash basket 72 of FIG. 2 and the wash basket 26 of FIG. 1 is that the upper edge 32 and the balance ring 33 of wash basket 72 are positioned higher than the upper edge 32 and the balance ring 33 of wash basket 26. This gives wash basket 72 a greater washing capacity than the wash basket 26. Wash basket 72 includes sidewalls 74 and a bottom wall 76.

The primary difference between the agitator 78 shown in FIG. 2 and the agitator 16 shown in FIG. 1 is that the agitator 78 extends upwardly a greater distance so as to accommodate the greater washing capacity of the second washing basket 72.

An important feature of the present invention is that the outer tub 14 remains unchanged between the configurations shown in FIGS. 1 and 2. Similarly the support braces 90 and transmission 88 also remain unchanged.

The second tub cover 80 includes a second tub cover rim 81 which is of different configuration than the tub cover rim 55 of the first tub cover 42. The inclined drain surface 56 and the horizontal surface 58 remain the same, but the downwardly tapered surface 82 of second tub cover rim 81 does not extend as far downwardly and the lower edge 84 of the second tub cover rim 81 is positioned a smaller distance below the upper edge 22 of the outer tub 14 then is the case with the first tub cover 42 shown in FIG. 1. The lower edge 84 of second tub cover rim 81 forms a second tub cover opening 86 which is registered with and adjacent the basket opening 41 of the second wash basket 72. Thus it is possible to interchange the first wash basket 26 with the second wash basket 72, the first agitator 16 with the second agitator 78, and the first tub cover 42 with the second tub cover 80 to change the capacity of the washing machine. This can be done without changing the configuration of the outer tub 14, the transmission 88, or the support braces 90.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

We claim:

1. A dual capacity washing machine, comprising:

an outer tub having an open end;

a first inner tub mounted within the outer tub and having a first predetermined capacity for receiving items to be washed;

a first tub cover mounted on the outer tub adjacent the periphery of the open end and including a surface extending toward the first inner tub to provide a transition into and out of the first inner tub;

a second inner tub selectively interchangeable with the first inner tub for mounting within the outer tub, the second inner tub having a second predetermined capacity for receiving items to be washed; and a second tub cover selectively interchangeable with the first tub cover for mounting on the outer tub adjacent the periphery of the open end and including a surface extending toward the second inner tub to provide a transition into and out of the second tub whereby the combination of first inner tub and first tub cover provide a first wash capacity and the combination of second inner tub and second tub cover provide a second wash capacity.

2. A dual capacity washing machine comprising:

an outer tub having peripheral tub rim forming a tub opening;

a first wash basket having a first basket capacity and mounted within said outer tub, said first wash basket having a peripheral first basket rim forming a first basket opening spaced a first distance from said tub opening;

a first tub cover mounted to said peripheral tub rim and having a first transition surface extending toward said first basket opening to provide a transition into and out of said first wash basket;

a second wash basket selectively interchangeable with said first wash basket for mounting within said outer tub, said second wash basket having a second basket capacity less than said first basket capacity and having a peripheral second basket rim forming a second basket opening, said second basket opening being spaced a second distance greater than said first distance from said tub opening;

a second tub cover selectively interchangeable with said first tub cover for mounting to said peripheral tub rim and having a second transition surface extending toward said second basket opening to provide a transition into and out of said second wash basket.

3. A dual capacity washing machine according to claim 2 wherein said first and second transition surfaces of said first and second tub covers substantially bridge said first and second distances respectively between said tub opening and said first and second basket openings respectively.

4. A dual capacity washing machine according to claim 2 wherein said first transition surface of said first tub cover forms a first tub cover opening registered with and adjacent said first basket opening when said first tub cover is attached to said outer tub and said first basket is within said outer tub, said second transition surface of said second tub cover forming a second tub cover opening registered with and adjacent said second basket opening when said second tub cover is mounted to said outer tub and said second basket is within said outer tub.

5. A dual capacity washing machine according to claim 2 wherein said first and second tub covers include attachment means comprising in cross-section a pair of spaced apart legs forming a U-shaped channel therebetween, said U-shaped channel fitting over said peripheral tub rim with said pair of spaced apart legs frictionally embracing said peripheral tub rim therebetween whenever said first and second top covers respectively are mounted to said peripheral tub rim.

6. A dual capacity washing machine according to claim 2 wherein a said first tub cover includes a first lock member thereon, said second tub cover includes a second lock member thereon, ant said outer tub includes a tub latch member thereon, said first and second lock members retentively engaging said tub latch member whenever said first and second tub covers respectively are mounted to said outer tub for detachably locking said first and second tub covers respectively to said outer tub.

7. A dual capacity washing machine according to claim 2 and further comprising a first agitator detachably mounted within said first wash basket and having a first axial length, a second agitator within said second wash basket and having a second axial length shorter than said first axial length.

8. A method for changing the washing capacity of a washing machine having an outer tub with a peripheral tub rim forming a tub opening, said method comprising:

mounting a first wash basket having a first wash basket capacity within said outer tub, said first wash basket having a first basket opening spaced a first distance from said tub opening;

mounting a first tub cover to said peripheral tub rim, said first tub cover having a first transition surface extending toward said first basket opening to provide a transition into and out of said first wash basket, whereby said first wash basket and said first tub cover combine to provide a first washing capacity;

removing said first wash basket and said first tub cover from said outer tub;

mounting a second wash basket having a second wash basket capacity less than said first wash basket capacity within said outer tub, said second wash basket having a second basket opening spaced a second distance greater than said first distance from said tub opening;

mounting a second tub cover to said peripheral tub rim, said second tub cover having a second transition surface extending toward said second basket opening to provide a transition into and out of said second wash basket, whereby said second wash basket and said second tub cover combine to provide a second washing capacity.

9. A method according to claim 8 wherein said first transition surface of said first tub cover forms a first tub cover opening and said second transition surface of said second tub cover forms a second tub cover opening, said method further comprising registering said first tub cover opening with said first wash basket opening when mounting said first tub cover to said outer tub, and registering said second tub cover opening with said second wash basket opening when mounting said second tub cover to said outer tub.

10. A method according to claim 9 and further comprising positioning said first tub cover opening adjacent said first wash basket opening when mounting said first tub cover to said outer tub and positioning said second tub cover opening adjacent said second wash basket opening when mounting said second tub cover to said outer tub.

11. A method according to claim 9 and further comprising bridging said first distance between said tub opening and said first basket opening with said first transition surface when mounting said first tub cover to said outer tub, and bridging said second distance between said tub opening and said second basket opening with said second transition surface when mounting said second tub cover to said outer tub.

* * * * *